United States Patent [19]

Hieronymi et al.

[11] 4,420,954

[45] Dec. 20, 1983

[54] FLUSH MOUNTABLE DOOR LATCH MECHANISM

[75] Inventors: Gabriel C. Hieronymi, Sloatsburg, N.Y.; Randall C. Hansen, Gurnee, Ill.

[73] Assignee: Abex Corporation, New York, N.Y.

[21] Appl. No.: 330,738

[22] Filed: Dec. 14, 1981

[51] Int. Cl.[3] ..... E05B 55/04; E05C 1/14

[52] U.S. Cl. ..... 70/150; 70/208; 70/472; 70/489; 292/173; 292/DIG. 31

[58] Field of Search ..... 70/150, 201, 202, 208, 70/472, 489; 292/165, 173, DIG. 31

[56] References Cited

U.S. PATENT DOCUMENTS

| | | | |
|---|---|---|---|
| 3,668,907 | 6/1972 | Pastva | 70/153 |
| 3,707,862 | 1/1973 | Pastva | 70/150 |
| 4,138,869 | 2/1979 | Pelcin | 70/151 R |
| 4,312,202 | 1/1982 | Pestva | 70/472 |
| 4,321,812 | 3/1982 | Pelcin | 70/472 |
| 4,335,595 | 6/1982 | Swan | 70/149 |

*Primary Examiner*—Robert L. Wolfe

*Attorney, Agent, or Firm*—Thomas S. Baker, Jr.

[57] ABSTRACT

A paddle handle actuated latch mechanism has the paddle handle pivotally mounted within a recess formed in a rectangular tray. A bolt is mounted in a housing attached to the back of the tray. A slide bar mounted in the bolt housing is connected to the bolt and has a portion which projects through an opening in the tray and is engaged by the handle when the handle is actuated. The lock bar is connected to the bolt such that when the paddle handle is moved from a stored position to an operated position, the slide bar moves from a locked position to an unlocked position which moves the bolt from an extended position to a retracted position.

8 Claims, 3 Drawing Figures

FLUSH MOUNTABLE DOOR LATCH MECHANISM

BACKGROUND OF THE INVENTION

This invention relates to a paddle handle actuated door latch mechanism which is adapted to be mounted in a door such that the paddle handle is flush with the surface of the door.

In a flush mounted paddle handle actuated door latch, it is common to have the handle pivotally mounted within a recessed opening formed in a rectangular tray. A bolt is commonly mounted in a housing which is attached to the back of the tray. When the latch mechanism is operated, the bolt moves from an extended position, in which it passes through the eye of a striker plate when the door is closed, to a retracted position, in which the bolt is withdrawn from the eye. A problem with the aforementioned design is that the handle, which is located on one side of the tray, must connect to and operate the bolt which is mounted in the housing on the opposite side of the tray.

In one previous design, the bolt is operated by an actuating member on the handle which projects through an opening in the bottom of the tray and is received in an opening formed in the bolt. A problem with this design is that the actuating member is difficult to attach to the handle. If the member is formed as part of the handle it is necessary for the handle to be made out of a relatively thick piece of material. Such a piece of material is expensive and difficult to work with. Another problem with this design is that water can flow through the opening in the tray into the opening in the bolt and freeze to prevent operation of the latch mechanism.

In another latch mechanism, a paddle handle pivots a cam member which is mounted on the handle pivot pin and which projects through an opening in the tray and into an opening in the bolt; this slides the bolt from an extended position to a retracted position. This design eliminates the need for constructing the handle from a relatively thick piece of material. Disadvantages to the design include more complexity because of additional parts, and the vulnerability of the cam member and bolt to freezing.

Many paddle handle actuated latch mechanisms have a lock which prevents unauthorized operation of the mechanism. A common lock has a cylinder and a cam which engages the bolt or a member connected to the handle to prevent movement of the bolt or handle when the latch mechanism is locked. It is common to connect the cam to the lock cylinder by a screw or a rivet. In some instances, it is possible for an intruder to render the lock inoperative by applying a large force to the paddle handle. This force is transmitted to the lock cam to shear the screw or rivet which attaches the cam to the lock cylinder.

It is an object of the instant invention to provide a paddle handle actuated latch mechanism in which the connection between the paddle handle and the bolt does not require a portion of the handle to directly engage the bolt and is resistant to freezing.

It is a further object of the instant invention to provide a lock for a paddle handle actuated latch mechanism in which the lock cylinder cam is formed in such a way as to resist shearing of the means which attaches the cam to the lock cylinder.

SUMMARY OF THE INVENTION

The instant invention provides a paddle handle actuated latch mechanism in which the paddle handle is pivotally mounted within a recess formed in a rectangular tray. A bolt is mounted in a housing which is attached to the back of the tray. A slide bar mounted in the bolt housing is attached to the bolt and has a portion which projects through an opening in the tray and is engaged by the handle when the handle is actuated. The lock bar is connected to the bolt such that, when the paddle handle is moved from a stored position to an operated position, the slide bar moves from a locked position to an unlocked position and, through its connection therewith, moves the bolt from an extended position to a retracted position. Additionally, the connection between the slide bar and the bolt is such that the bolt can move relative to the slide bar when the slide bar is locked. Consequently, the bolt can move from the extended position to the retracted position to enable closing of the door containing the latch mechanism when the mechanism is locked.

In addition, the instant latch mechanism has a lock mechanism which includes a lock cylinder and a lock cylinder cam which prevent movement of the slide bar when the lock mechanism is locked. A portion of the lock cylinder cam is contoured to complement the lock cylinder and the cam is positioned in close proximity to the lock cylinder, such that the contoured portion engages the lock cylinder when an attempt is made to force the paddle handle to operate the latch mechanism when the mechanism is locked. This resists shearing or breaking of the means which fastens the lock cylinder cam to the lock cylinder.

DESCRIPTION OF THE PREFERRED EMBODIMENT

Figure 1:
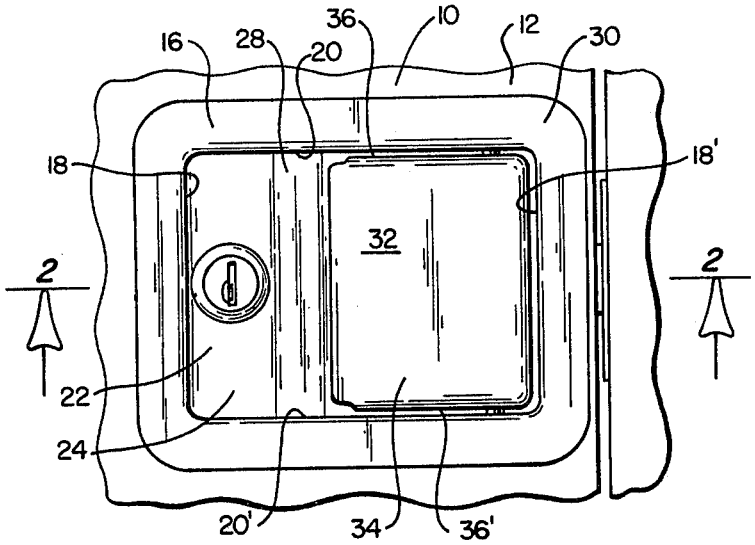
FIG. 1 is a plan view of the paddle handle latch mechanism of the instant invention.
Figure 2:
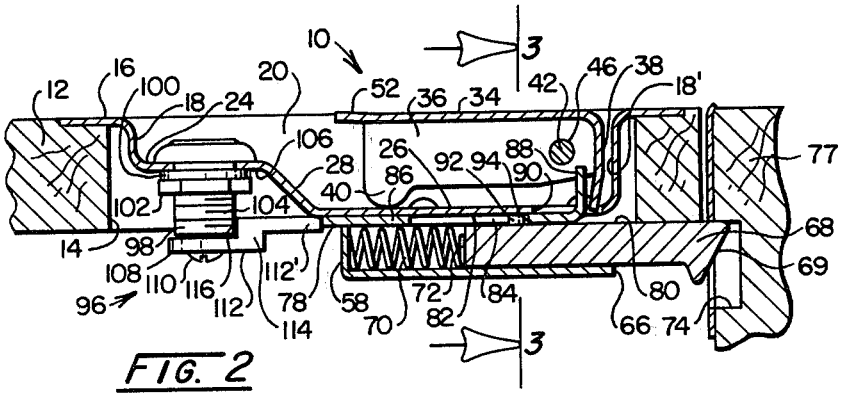
FIG. 2 is a longitudinal cross-section along line 2—2 of FIG. 1.
Figure 3:
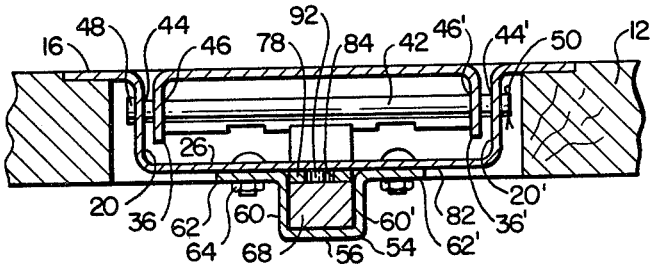
FIG. 3 is a lateral cross-section along line 3—3 of FIG. 2.

Referring to FIGS. 1–3, a latch mechanism 10 is shown mounted flush in a door 12 with a major portion of the mechanism 10 projecting through an opening 14 formed in the door 12. The latch mechanism 10 includes a rectangular pan-shaped tray 16, the depth of which is defined by a pair of end walls 18, 18', a pair of sidewalls 20, 20' and a stepped bottom wall 22. Bottom wall 22 comprises an upper surface 24 which is joined to a lower surface 26 by a short angled surface 28. Referring to FIG. 2, it can be seen that surface 26 is at a greater depth in the tray 16 than surface 24. The top edges of the end walls 18, 18' and the sidewalls 20, 20' merge into a peripheral flange 30 which forms the top surface of the tray 16.

A rectangular handle 32, which is defined by a top surface 34, a pair of perpendicular sidewalls 36, 36' and a perpendicular back wall 38, actuates the latch mechanism 10. An ear 40 projects from the end of each sidewall 36, 36' opposite the back wall 38. The handle 32 is pivotally connected to the tray 16, such that it overlies the deeper surface 26, by a pin 42 which passes successively through a hole 44 in tray sidewall 20, a hole 46 in handle sidewall 36, a hole 46' in handle sidewall 36' and a hole 44' in tray sidewall 20'. Pin 42 has a head 48 at one end and is retained in position by a cotter pin 50 which passes through a bore in the other end.

When handle 32 is in the closed position, the sidewall ears 40 engage bottom wall surface 26 such that the handle top surface 34 overlies and is parallel to the deeper portion of the tray 16. In this position the handle back wall 38 is aligned with the tray end wall 18' and the open end of the handle 32 faces the shallower portion of the tray 16 which, in part, is defined by surface 24. The end 52 of handle top surface 34 which is nearest the shallow portion of the tray 16 is curved slightly outward so that it can be easily grasped by an operator's fingers.

Referring to FIGS. 2 and 3, a generally rectangular bolt housing 54 is defined by a bottom wall 56, an end wall 58 and a pair of sidewalls 60, 60' each of which merges into a flange 62, 62'. Housing 54 is attached to the back of lower tray surface 26 by a plurality of nut-and-bolt fasteners 64. The bolt housing 54 has an open end 66 from which a one-piece, solid, generally rectangular bolt 68 projects. The bolt 68 has an angled front edge 69. A spring 70 interposed between the end wall 58 of housing 54 and a back end wall 72 on bolt 68 biases the bolt 68 to an extended position away from end wall 58.

Referring to FIG. 2, it can be seen that when the bolt 68 is in the extended position and the door 12 is closed, the bolt 68 projects through an eye 74 formed in a striker plate 76 mounted in a door frame 77 to latch the door closed. Referring to FIGS. 2 and 3, an L-shaped slide bar 78 is mounted in bolt housing 54 between the top surface 80 of the bolt 68 and the back of bottom wall surface 26. Slide bar 78 is approximately the same width as bolt 68 and has a central elongated slot 84 formed in its longer leg 86. The shorter leg 88 of slide bar 78 projects upwardly through a short rectangular slot 90 formed in bottom wall 22 near tray end wall 18'. A pin 92, which is formed in the top surface 80 of bolt 68, projects upwardly a distance equal to the thickness of slide bar 78 and is received in the slide bar slot 84. When the bolt 68 is in the extended position, the spring 70, acting through bolt 68, pin 92, and end wall 94 of slide bar slot 84, biases the bar 78 into engagement with the back wall 38 of handle 32. As a result, the handle 32 is biased in a counterclockwise direction, as viewed in FIG. 2, to its flush or inoperative position, with handle ears 40 firmly against bottom wall surface 26.

A lock 96 is mounted in tray bottom surface 24. The lock 92 includes a lock cylinder 98 which projects through a non-circular hole 100 formed in surface 24. A nut 102 is turned onto the threaded outer surface 104 of cylinder 98 and is tightened against the back of surface 24. A lock cylinder cam 108 is attached to the bottom of lock cylinder 98 by a bolt 110. Cam 108 has a pair of legs 112, 112' which are off-set from each other by a short connecting section 114. Section 114 has an inner surface 116 which is contoured to complement the cylindrical outer surface 104 of lock cylinder 98 and is located in close proximity to that surface. Leg 112' of lock cylinder cam 108 is directly aligned with slide bar 78 when the lock 96 is in the locked position. In this position, the slide bar 78 cannot be moved by operation of the handle 32. Any attempt to pivot the handle 32 clockwise, as seen in FIG. 2, to its open position while lock 96 is locked, is prevented by engagement of cam leg 112' with one end of lock bar 78. This engagement also prevents shearing of the bolt 110 since leg 112 will bend and section 114 will engage cylinder surface 104 before bolt 110 will shear. If lock 96 is locked when the door 12 is open, the door 12 can still be closed because the bolt 68 can retract within housing 54 when the angled front edge 69 of bolt 68 engages the front edge of striker plate 76, since the bolt pin 92 can move in slot 84 relative to the slide bar 78.

In order to manually operate the latch mechanism 10 of the instant invention, the lock 96 is moved to the unlocked position in which the lock cylinder cam 108 is rotated 90° from the position shown in FIG. 2 to move leg 112' out of engagement with the back of slide bar 78. When the lock is unlocked, an operator can grasph the end 52 of handle 32 and pivot the handle 32 in a clockwise direction, as viewed in FIG. 2. This causes the handle back wall 38 to engage the shorter leg 88 of slide bar 78 and move the slide bar to the left. As the slide bar moves to the left, the end wall 94 of slot 84 engages the bolt pin 92 and moves the bolt 68 to the left in bolt housing 54 to the retracted position. This withdraws the bolt 68 from the eye 74 of the striker plate 76 in the door frame 77 and permits the door 12 to open. When the handle 32 is released, the spring 70 biases the bolt 68 to the extended position and causes the slide bar 78 to pivot the handle 32 to the closed position.

Referring to FIG. 2, it can be seen that the ears 40 on the handle 32 define the stored position of the handle 32 and that the back wall 38 of the handle defines a stop for the slide bar 78. The extended position of the bolt 68 is defined by the position of the bolt 68 when the bolt pin 92 engages the end wall 94 of the slot 84 formed in the slide bar 78.

In some applications it is desirable to provide a latch mechanism 10 which does not permit an open door to be closed when the lock is in the locked position. To accomplish this, the illustrated slide bar 78 having elongated slot 84 can be replaced by a slide bar having a circular bore the same size as pin 92, with the bore being so located that the bolt 68 is in the extended position when the handle 32 is in the stored position, as shown in FIG. 2.

Referring to FIGS. 1 and 2, it can be seen that bolt 68 is solid and that slide bar 78 does not move relative to bolt 68 when the mechanism 10 is operated. During operation, handle wall 38 moves against slide bar 78 and slide bar 78 moves relative to wall 22. It has been found that this construction is highly resistant to being rendered inoperative by water entering the mechanism and subsequently freezing. Further, the back wall of the handle 32 which engages the slide bar 78 can be relatively narrow, since it does not engage bolt 68. This enables the handle 32 to be constructed from a relatively lightweight and thin material.

Although a preferred embodiment of the invention has been illustrated and described, it will be apparent to those skilled in the art that various modifications may be made without departing from the spirit and scope of the present invention.

What is claimed is:

1. A latch mechanism which comprises a tray; a bottom surface formed in the tray, wherein the bottom surface of the tray is recessed; a handle; means for pivotally mounting the handle within the tray such that the handle overlies the recessed bottom surface, wherein the handle is pivotable between a stored position and an operated position; an actuator formed on one end of the handle; means for housing a bolt, wherein the housing means is on back of the bottom surface of the tray; a bolt slidably mounted in the housing means and movable between an extended position and a retracted position; means for biasing the bolt into the extended position; a top surface on the bolt which faces the bottom surface of the tray; a slot formed in the bottom surface of the tray; a slide bar mounted in the bolt housing between the bottom surface of the tray and the top surface of the bolt, wherein the slide bar is movable between a locked position and an unlocked position and a part of the slide bar projects upwardly through the slot in the bottom surface; and means connecting the slide bar with the bolt, wherein the biasing means biases the bolt into engagement with the slide bar and the handle actuator engages the slide bar projection as the handle is moved from the stored position to the operated position to move the slide bar from the locked position to the unlocked position which simultaneously moves the bolt from the extended position to the retracted position.

2. The latch mechanism of claim 1, wherein the biasing means biases the slide bar into engagement with the handle actuator to bias the handle towards the stored position

3. The latch mechanism of claim 2, wherein the handle includes a top surface, a back wall, a pair of perpendicular sidewalls and means on the sidewalls for maintaining the top surface parallel to the bottom surface of the tray when the handle is in the stored position.

4. The latch mechanism of claim 3, wherein the handle actuator includes the back wall of the handle.

5. The latch mechanism of claim 1, wherein the means connecting the slide bar with the bolt includes an opening formed in the lock bar, an extension member affixed to the bolt and the extension member is received in the lock bar opening.

6. The latch mechanism of claim 5, wherein the slide bar opening is enlarged to permit the bolt extension member to move relative to the slide bar so the bolt can move from the extended position to the retracted position while the slide bar remains in the locked position.

7. The latch mechanism of claim 6, which includes lock means for preventing the handle actuator from moving the slide bar from the locked to the unlocked position.

8. The latch mechanism of claim 7, wherein the lock means includes a lock cylinder and a lock cylinder cam, the lock cylinder cam is movable between a first position in which the cam is out of engagement with the slide bar and the handle actuator can move the slide bar into the unlocked position and a second position in which the cam engages the slide bar and the slide bar is maintained in the locked position, and a portion of the lock cylinder cam is contoured to complement the outer surface of the lock cylinder and is located in close proximity to the outer surface to thereby cause the lock cylinder cam to engage the outer surface when the lock is locked and the handle is forced towards the operated position.

* * * * *